US010350611B2

(12) United States Patent
Roth

(10) Patent No.: US 10,350,611 B2
(45) Date of Patent: Jul. 16, 2019

(54) APPARATUS AND METHODS FOR PARTICLE SEPARATION BY FERROFLUID CONSTRICTION

(71) Applicant: General Electric Company, Schenectady, NY (US)

(72) Inventor: Paul Gregory Roth, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/634,231

(22) Filed: Jun. 27, 2017

(65) Prior Publication Data

US 2018/0369832 A1 Dec. 27, 2018

(51) Int. Cl.

| | |
|---|---|
| ***B03C 1/32*** | (2006.01) |
| ***B03C 1/033*** | (2006.01) |
| ***B22F 1/00*** | (2006.01) |

(52) U.S. Cl.

CPC ..... *B03C 1/32* (2013.01); *B03C 1/0332* (2013.01); *B03C 1/0335* (2013.01); *B22F 1/0081* (2013.01); *B03C 2201/18* (2013.01); *B03C 2201/20* (2013.01); *B22F 2202/05* (2013.01)

(58) Field of Classification Search

CPC ..... B03C 1/32; B03C 2201/20; B22F 1/0081

USPC ..... 209/39, 40, 214, 215, 231, 322

See application file for complete search history.

(56) References Cited

U.S. PATENT DOCUMENTS

| | | | | | |
|---|---|---|---|---|---|
| 3,133,876 | A * | 5/1964 | Klass | B03C 7/02 | 209/1 |
| 3,796,660 | A * | 3/1974 | Kaiser | B01D 17/04 | 210/695 |
| 4,514,285 | A * | 4/1985 | Niccum | C10G 11/16 | 208/148 |
| 4,668,379 | A * | 5/1987 | Rosensweig | B01D 15/02 | 208/157 |
| 4,816,143 | A * | 3/1989 | Vollmar | B03C 1/035 | 209/212 |
| 4,961,841 | A * | 10/1990 | Andres | B03B 7/00 | 209/1 |
| 6,020,210 | A * | 2/2000 | Miltenyi | B03C 1/002 | 209/213 |

(Continued)

OTHER PUBLICATIONS

Forte, James Andrew, "Nonmagnetic particle separation using ferrofluids controlled by magnetic fields" (2009). Mechanical Engineering Master's Theses. Paper 21. http://hdl.handle.net/2047/d20000033.

(Continued)

*Primary Examiner* — Terrell H Matthews

(74) *Attorney, Agent, or Firm* — Dority & Manning, P.A.

(57) ABSTRACT

Methods for separating particles in a ferrofluid, along with apparatus for performing the same, are provided. The method may include introducing the ferrofluid through a separation tube; applying a magnetic field to the separation tube such that a fluid constriction is created within the tube that leads to a density gradient in the fluid with a maximum value ($d_{max}$) at some region along the tube; and introducing a plurality of particles into the ferrofluid within the separation tube such that particles having densities greater than $d_{max}$ flow through the ferrofluid.

11 Claims, 2 Drawing Sheets

(56) References Cited

U.S. PATENT DOCUMENTS

| | | | | |
|---|---|---|---|---|
| 6,432,630 | B1 * | 8/2002 | Blankenstein | B01D 57/02 422/186 |
| 6,994,219 | B2 * | 2/2006 | Roth | B03C 1/0332 209/210 |
| 8,689,981 | B2 * | 4/2014 | Stone | B03C 1/288 209/214 |
| 9,517,474 | B2 * | 12/2016 | Mao | B03C 1/32 |
| 2014/0332449 | A1 * | 11/2014 | Nishijima | B03B 5/623 209/39 |
| 2015/0226657 | A1 * | 8/2015 | Foster | G01N 15/10 435/287.1 |
| 2016/0296944 | A1 * | 10/2016 | Koser | B03C 1/0332 |

OTHER PUBLICATIONS

Zhu et al., Continuous separation of non-magnetic particles inside ferrofluids, Apr. 20, 2010, Springer-Verlag, Microfluid Nanofluid 9, pp. 1003-1009.

* cited by examiner

APPARATUS AND METHODS FOR PARTICLE SEPARATION BY FERROFLUID CONSTRICTION

FIELD OF TECHNOLOGY

This invention relates to the separation of particle fractions from a particulate feed and, more particularly, to such a separation accomplished using ferrofluid constriction created by an applied magnetic field.

BACKGROUND

Powder metallurgical processes offer an alternative to casting and casting-and-working for the production of metallic articles. In a powder metallurgical process, the alloy that is to constitute the article is first prepared in a fine-particle form. A mass of the alloy particulate is compacted to the required shape at elevated temperature with or without a binder. For example, hot isostatic pressing is a binderless process used to manufacture a number of aerospace and other types of parts. Where they can be used, powder metallurgical processes offer the advantages of a more-homogeneous microstructure in the final article, and reduced physical and chemical contaminants in the final article.

The powder used in the powder metallurgical process is typically produced by a method in which the precursor metal of the powder contacts the ceramics in melting crucibles or powder-production apparatus. The result is that the metallic powder particles are intermixed with a small fraction of fine ceramic particles. The presence of the ceramic particles may be acceptable or unacceptable, depending upon the size, composition, and volume fraction of ceramic particles that are present.

When a batch of powder material is received by the manufacturer of the final article from the manufacturer of the powder, the batch may be evaluated as to whether it is acceptable or unacceptable for use in the manufacturing of the final article. One test that may be used to make this evaluation requires that the ceramic fraction of the particles be separated from the metallic fraction, and that the ceramic fraction be analyzed for size and composition of the individual particles. Flotation separation techniques involve mixing a particulate feed into a fluid of the proper density, so that the lighter ceramic particle fraction floats, and the heavier metallic particle fraction sinks. Currently available flotation fluids with the required high specific gravity to achieve this flotation separation include toxic elements such as the thallium component of Clerici's Reagent. An alternative separation technique uses a nontoxic ferrofluid with an applied magnetic field to create a density gradient in the fluid to effect a similar separation. Available ferrofluidic separation devices are complex in structure and fragile. Because of their internal complexity, there are many places for the particles to be trapped within the devices. The result is that the devices are difficult to clean between runs, leading to a significant chance of cross-contamination from one run to the next.

There is a need for an improved approach to the separation of particle fractions, as required for the analysis of the particles and other purposes. The present invention fulfills this need, and further provides related advantages.

BRIEF DESCRIPTION

Aspects and advantages will be set forth in part in the following description, or may be obvious from the description, or may be learned through practice of the invention.

Methods are generally provided for separating particles in a ferrofluid, along with apparatus for performing the same. In one embodiment, the method includes introducing the ferrofluid through a separation tube; applying a magnetic field to the separation tube such that a fluid constriction is created within the tube that leads to a density gradient in the fluid with a maximum value ($d_{max}$) at some region along the tube; and introducing a plurality of particles into the ferrofluid within the separation tube such that particles having densities greater than $d_{max}$ flow through the ferrofluid.

A particle separation device is also generally provided, which may include a separation tube defining an inlet at a first end and an outlet at a second end; a magnet positioned adjacent to or straddling the separation tube; a first valve positioned at the second end; a holding tube having a first end in communication with the separation tube via the first valve; and a second valve in communication with a second end of the holding tube.

These and other features, aspects and advantages will become better understood with reference to the following description and appended claims. The accompanying drawings, which are incorporated in and constitute a part of this specification, illustrate embodiments of the invention and, together with the description, serve to explain certain principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended Figs., in which.

Figure 1:
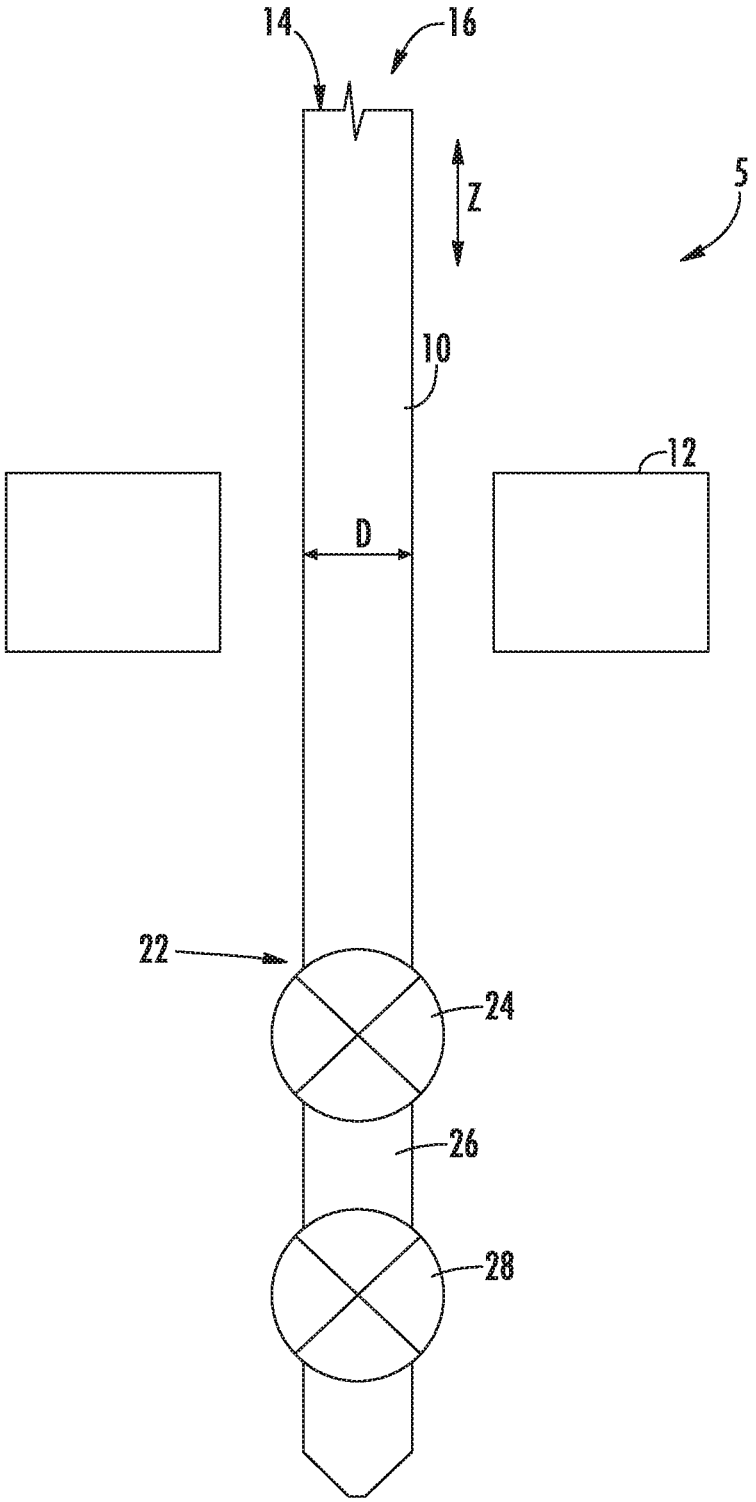
FIG. 1 shows an exemplary ferrofluid separation system in accordance with one embodiment.

Repeat use of reference characters in the present specification and drawings is intended to represent the same or analogous features or elements of the present invention.

DETAILED DESCRIPTION OF PARTICULAR EMBODIMENTS

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

Generally, methods are generally provided for separating particles of different size and/or density within a ferrofluid. As used herein, the term "ferrofluid" is a stable colloidal suspension of nanoscale ferromagnetic particles suspended in a carrier fluid, such as an organic solvent or water.

Figure 2:
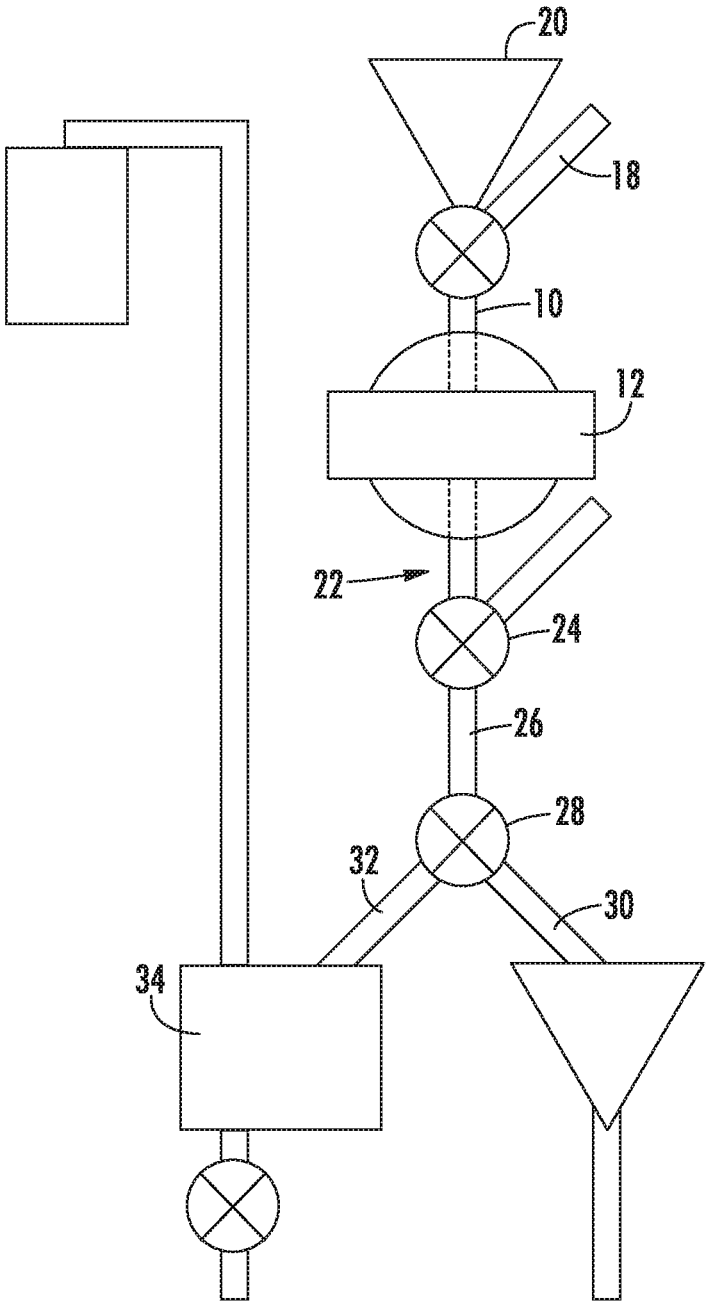
FIG. 2 shows an exemplary ferrofluid separation system in accordance with another embodiment.

Referring to FIGS. 1 and 2, a particle separation device 5 is shown that includes a separation tube 10 placed between the poles of a magnet 12. The magnet 12 is generally positioned such that a magnetic field may be placed upon the separation tube 10. For example, the magnet may have a strength that is less than that about 20,000 gauss (Gs) that is the saturation point of iron, such as about 5,000 Gs to about 15,000 Gs. Either permanent and/or non-superconducting electromagnets may be used. In one embodiment, the separation tube 10 is constructed from a non-magnetic material (e.g., PVC) so as to avoid interfering with the magnetic field created by the magnet 12 on the contents of the separation tube 10.

The separation tube 10 may be arranged with a vertical vector to allow gravity to pull particles through the separation tube 10. In the embodiment shown, the separation tube 10 is oriented substantially vertically. A ferrofluid may be introduced into the separation tube 10, such as through the inlet 14 at its first end 16 in FIG. 1 or through the fluid tube 18 of FIG. 2. The ferrofluid is introduced into the separation tube 10 in a volume to fill it past the magnet 12.

Upon magnetization, a density constriction is produced within the ferrofluid between the poles of the magnet 12. Within the separation tube 10, the ferrofluid density has a maximum value at some point between the poles that depends on the resting concentration of the fluid, and on the strength of the magnet. Moving away from the magnet in both upward and downward directions, the density in the column decreases. Let d(z) be the minimum fluid density in a horizontal cross section (i.e., the diameter D) of the separation tube at a vertically measured coordinate z. The value d(z) increases as z moves toward the magnetic from the top, attains a maximum value $d_{max}$ at some point between the poles, and then decreases as z continues downward away from the magnet.

After filling the separation tube 12 with a ferrofluid, nonmagnetic particles may be introduced into the separation tube 12 (e.g., at the inlet 14 or via a feeder 20). In one embodiment, a slurry of powder metal in ferrofluid is fed into the top of the separation tube at a slow rate. In one embodiment, a slow drain of the ferrofluid from the separation tube may be utilized to match the added volume to maintain a fixed level in the column. A wetting agent may be included in the ferrofluid and/or the slurry of powder to inhibit coagulation of the particles therein. Additionally or alternatively, vibratory agitation may be used in the separation zone to inhibit coagulation of the particles therein.

When a particle having density less than $d_{max}$ is placed in the ferrofluid above the magnet 12, its downward fall will be arrested by the constriction. When a particle having density greater than $d_{max}$ is placed in the ferrofluid above the magnet, it will fall through the constriction. Thus, a mixture of particles of densities greater than and less than $d_{max}$ is introduced into the column above the magnet is separated with the heavy fraction passing through the magnet 12 to the second end 22, and the light fraction trapped above the constriction.

Given a permanent magnet, the separation split point ($d_{max}$) can be controlled though the concentration of the ferrofluid. For example, the separation split point ($d_{max}$) may be lowered by diluting the ferrofluid. Additionally or alternatively, an electromagnetic having adjustable field strength may provide additional control over the split point.

As such, particles may then be separated based on their density by passing through the magnetized ferrofluid within the separation tube 10. That is, a plurality of particles having varying densities may be introduced into the tube at the top end and allowed to fall, through gravity, into the ferrofluid. Particles having densities less than $d_{max}$ will be held in the ferrofluid (above the constriction created therein), while particles having densities greater than $d_{max}$ will fall through the constriction and to the second end 22 at the bottom of the separation tube 10.

The particles having densities greater than $d_{max}$ may then be collected from the second end 22 of the separation tube 10. For example, referring to FIG. 1, the top valve 24 may be opened to allow the particles having densities greater than $d_{max}$ to fall out of the separation tube 10 and into the holding tube 26. The holding tube 26 is defined between a bottom valve 28 and the top valve 24 for collection of the particles having densities greater than $d_{max}$ without any of the particles having densities less than $d_{max}$ that float above the constriction within the separation tube 10. The top valve 24 may then be closed to isolate the particles having densities greater than $d_{max}$ from the separation tube 12.

Now that the particles having densities greater than $d_{max}$ are in the holding tube 26, the bottom valve 28 may be opened to collect the particles having densities greater than $d_{max}$ that passed the magnet. The bottom valve 28 may direct these denser particles into any suitable container. For example, referring to FIG. 2, the bottom valve 28 may be an inverted Y valve configured to direct the particles having a density that is greater than $d_{max}$ into a first collection tube 30. These denser particles may then be collected and dried, if desired.

Upon closing the top and bottom valves 24, 28, the magnetic field may be removed from the separation tube 10, effectively eliminating the constriction formed within the separation tube 10 to allow the particles having densities less than $d_{max}$ to fall to the bottom of the separation tube 10 on the top valve 24. The particles having densities less than $d_{max}$ may then be passed to the collection tube 26 by opening the top valve 24. For example, referring to FIG. 2, the inverted Y valve (i.e., the bottom valve 28) may be configured to direct the particles having densities less than $d_{max}$ into a second collection tube 32.

In the embodiment of FIG. 2, the particles having densities less than $d_{max}$ may be collected on a filter 34 while the ferrofluid passes through the filter for recovery and reuse. For example, the filter 34 may include a fine mesh screen. The collected particles having densities less than $d_{max}$ may then be dried for sizing and chemical analysis. In one embodiment, after salvaging the ferrofluid below the screen, the column may be purged and washed to be reused for further particle separations.

EXAMPLES

A prototype device patterned after FIG. 1 was successfully demonstrated. Using Ferrotec MSG series ferrofluid in a 0.5 inch ID acrylic tube, small #4 brass nuts (sp g 8.4) were separated from 4.5 mm alumina balls (sp g 3.95). The tube was double stopped at the bottom, and supported between the poles of a permanent magnet. The bottom stopcock was closed, the top one opened, and the column filled, not quite to the top, with ferrofluid. The brass and alumina were then dropped into the column. Very shortly thereafter, clicks were heard, presumably the brass nuts settling onto the bottom stopcock. After several minutes, the top stopcock was closed and then the lower one opened, draining the contents of the bottom tube stub onto a screen. The brass nuts had passed through the magnet, and were captured on the screen.

The nuts were removed, and the screen repositioned under the column. The top stopcock was opened. The remaining contents of the column drained onto the screen, and the alumina balls were captured.

This written description uses exemplary embodiments to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A method of separating particles in a ferrofluid, the method comprising:

introducing the ferrofluid through a separation tube;

applying a magnetic field to the separation tube such that a fluid constriction is created within the tube that leads to a density gradient in the fluid with a maximum value ($d_{max}$) at some region along the tube;

introducing a plurality of particles into the ferrofluid within the separation tube, wherein particles having densities greater than $d_{max}$ flow through the ferrofluid;

opening a first valve attached to the separation tube to allow the particles having densities greater than dmax flow from the separation tube through the first valve into a holding tube;

closing the first valve; and opening an inverted Y valve to allow the particles having densities greater than dmax flow through the inverted Y valve into a first collection tube.

2. The method of claim 1, wherein particles having densities less than $d_{max}$ remain in the ferrofluid.

3. The method of claim 1, wherein the separation tube is oriented with a vertical vector such that gravity pulls the particles having densities greater than $d_{max}$ through the ferrofluid and past the region of $d_{max}$.

4. The method of claim 3, wherein the separation tube is oriented substantially vertically such that gravity pulls the particles having densities greater than $d_{max}$ through the ferrofluid to the bottom of the separation tube.

5. The method of claim 1, further comprising:

closing the inverted Y valve to the first collection tube;

removing the magnetic field from the separation tube so that particles having densities less than $d_{max}$ flow through the ferrofluid.

6. The method of claim 5, further comprising:

opening the first valve to allow particles having densities less than $d_{max}$ flow through into the holding tube; and opening the inverted Y valve to allow the particles having densities less than $d_{max}$ flow through the inverted Y valve into a second collection tube.

7. The method of claim 1, wherein the particles are nonmagnetic.

8. A particle separation device, comprising:

a separation tube defining an inlet at a first end and an outlet at a second end;

a magnet positioned adjacent to or straddling the separation tube;

a first valve positioned at the second end;

a holding tube having a first end in communication with the separation tube via the first valve; and a second valve in communication with a second end of the holding tube, wherein the second valve is an inverted Y valve in independent communication with a first collection tube and a second collection tube.

9. The particle separation device of claim 8, wherein the separation tube is oriented with a vertical vector.

10. The particle separation device of claim 8, wherein the separation tube is oriented substantially vertically.

11. The particle separation device of claim 8, wherein the separation tube is constructed of a non-magnetic material.

* * * * *